US005897028A

United States Patent [19]

Sauer

[11] Patent Number: 5,897,028

[45] **Date of Patent: *Apr. 27, 1999**

[54] TWO COMPONENT ADHESIVE DISPENSING UNIT

[75] Inventor: Jochem Sauer, Saffron Walden, United Kingdom

[73] Assignee: Ciba Specialty Chemicals Corporation, Tarrytown, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/377,720

[22] Filed: Jan. 24, 1995

[30] Foreign Application Priority Data

Jan. 26, 1994 [GB] United Kingdom ..... 9401439

[51] Int. Cl.[6] ..... B67D 5/00

[52] U.S. Cl. ..... 222/82; 222/105; 222/326; 222/386.5; 222/567

[58] Field of Search ..... 222/135, 137, 222/95, 105, 131, 145.1, 145.5, 82, 83, 326, 327, 386, 386.5, 391, 567

[56] References Cited

U.S. PATENT DOCUMENTS

| | | | |
|---|---|---|---|
| 3,323,682 | 6/1967 | Creighton, Jr. et al. | 222/94 |
| 3,946,908 | 3/1976 | Yoon | 222/327 |
| 4,072,250 | 2/1978 | Pedersen et al. | 222/326 |
| 5,139,171 | 8/1992 | M äder | 222/326 |
| 5,161,715 | 11/1992 | Giannuzzi | 222/82 |
| 5,224,628 | 7/1993 | Keller | 222/137 |
| 5,273,190 | 12/1993 | Lund | 222/326 |
| 5,332,122 | 7/1994 | Herold et al. | 222/326 |

FOREIGN PATENT DOCUMENTS

| | | | |
|---|---|---|---|
| 2733692 | 5/1993 | Australia . | |
| 291753 | 11/1988 | European Pat. Off. . | |
| 302819 | 2/1989 | European Pat. Off. . | |
| 319666 | 6/1989 | European Pat. Off. . | |
| 377287 | 7/1990 | European Pat. Off. . | |
| 472448 | 2/1992 | European Pat. Off. . | |
| 541972 | 5/1993 | European Pat. Off. . | |
| 8901554 | 7/1989 | Germany . | |
| 3927805 | 8/1990 | Germany . | |
| 669165 | 2/1989 | Switzerland . | |
| 955192 | 4/1964 | United Kingdom . | |
| 2082686 | 3/1982 | United Kingdom | 222/137 |
| 2148236 | 5/1985 | United Kingdom . | |
| 2188373 | 9/1987 | United Kingdom . | |
| 2255596 | 11/1992 | United Kingdom . | |
| 8908241 | 9/1989 | WIPO . | |

*Primary Examiner*—Philippe Derakshani
*Attorney, Agent, or Firm*—David R. Crichton

[57] ABSTRACT

The present invention relates to a disposable manifold unit for a dispensing gun for two component sausage packs. The disposable manifold unit includes a housing having two parallel cylinders. Each cylinder has a closed end and an open end, wherein each closed end has a passage therethrough. A fixing device is provided on the outer side of the closed ends for affixing a mixing nozzle thereto with each passage for dispensing a mixture of the two component sausage packs. Each cylinder is of such length and diameter as will enable it to receive and retain a discharged sausage from a dispensing gun.

8 Claims, 4 Drawing Sheets

TWO COMPONENT ADHESIVE DISPENSING UNIT

THE BACKGROUND OF THE INVENTION

The present invention relates to a manifold unit for a two component dispensing gun.

These days two-component cartridges are often used for the dispensing of two-component materials such as adhesives. By virtue of their dimensions, they provide the right mixing ratio of the two components; and through a connected static mixer nozzle homogeneity of the substance is achieved. By using these two-component cartridges, together with specially designed dispensing guns, which may be manually or pneumatically driven, ready-to-use adhesive can be applied from the mixer nozzle.

The disadvantage of the two-component cartridge systems is that the cartridges, once emptied, have a relatively high waste volume and weight. This is not in line with the increasing ecological awareness in both legislation and consumer behaviour.

One way to enjoy the advantages of ready-to-use adhesive, achieved by using the two-component cartridge systems, while at the same time creating less waste is the concept of using sausage packs. In these, each component is packed in a single sausage. For dispensing these two-component sausage packs, special dispensing guns are already available on the market. They are manually or pneumatically driven. Unfortunately these existing two-component sausage guns have some tremendous disadvantages regarding their user-friendliness. Very often, reactive two-component materials are packed in the sausages. With these materials, skin contact should be avoided. As a result, the smeary handling, especially when removing the emptied sausage packs from the guns is a major difficulty. Furthermore, parts of these guns, especially the front-manifold to the mixer is contaminated with both material components. Material contamination can also occur on the inside walls of the sausage cylinder of the gun. If the A and B components of the guns are mistakenly interchanged on re-loading, i.e. putting the A-contaminated frontend side onto a B-sausage, functional problems can occur with these sausage guns and the mixed materials through an unintentional reaction of both material components. Moreover, it is not possible to use these guns for different types of materials without first cleaning them, an effort which diminishes the user' productivity.

We have now developed a disposable manifold unit (front end) for dispensing guns which overcomes these disadvantages.

SUMMARY OF THE INVENTION

Accordingly the present invention provides a disposable manifold unit for a dispensing gun for two component sausage packs, which comprises a housing having two parallel cylinders, each having a closed end and an open end, each closed end having a passage therethrough, fixing means on the outer side of the closed ends for affixing a mixing nozzle for dispensing a mixture of the two components, and wherein each cylinder is of such a length and diameter as will enable it to receive and retain a discharged sausage from a dispensing gun.

The two cylinders in the disposable front end have an inner diameter similar to the inner diameter of the sausage compartments (barrels) of the gun to which the front end is fitted.

When the sausages are dispensed and emptied, the pistons of the guns which are preferably lip seal pistons, move into or stop immediately before the cylindrical parts of the disposable front ends, and press the folded sausage casing into them. The two-component materials are prevented from getting into contact with the gun by the sealing effect of the expanding sausage foil against the inside of the cylindrical walls of the disposable front end under application pressure. In order to achieve this the sausage foil casing should have a diameter which is similar to or slightly larger than the inner diameter of the sausage compartment. In order to load the sausages with the slightly larger dimensions, the sausage should not be filled with so much material that they are stiff. They should have slightly less material so that the sausages are flexible and can be inserted into the compartments. Improved cleanliness is also achieved by the concertina-like folds of the emptied sausages, which wipe the material into the front end and cover them from behind.

The use of sausages with a casing diameter which is similar or slightly larger than the inner diameter of the sausage compartment also improves the mixing ratio accuracy of the two components both from the beginning and during use by avoiding uncontrolled expansions of the sausage casing under application pressure. It also avoids any dripping effects after adhesive application.

After a set of sausages has been emptied through the pressure of the pistons to its The disposable front end, containing the folded, emptied sausage casings, can be disposed of as a whole unit.

The disposable front end of the invention is preferably made of a plastics material and may be easily made by injection moulding.

Punching of the sausages before application can either be achieved with external punching tools, or through an integrated punch. Using punching tools means their unavoidable contamination with the two-component material and extra time being spent on punching and cleaning the tools, or creating waste by throwing away contaminated one-way tools. It is preferable to punch the sausages automatically when the pistons are applying application pressure to the sausages. This can be achieved by means of specially designed punching nozzles around the passages of the frontend to the mixer. These punching nozzles can be moulded with the rest of the disposable front end as one part. They may be designed such that, when pressure is first applied from the pistons to the sausages, high stress concentration points will appear in the sausage foil, first at the nozzle points and afterwards at the cutting edges of the nozzle points. The foil will then be cut, for example, on three sides in a rectangular shape. The remaining side will retain the fold of foil.The punching nozzles are preferably positioned eccentrically in the cylindrical parts of the frontend. Therefore a punching of that part of the sausage foil with the closure clamps is avoided. This avoids the danger of a mixer blockage or a weak bonding area. These cut folds of foil may then swing away into specially designed openings in the mixer due to the pressure of the dispensed materials. Thus, large sections of the sausage may be opened to allow a good flow of material into the mixer.

The punching geometries integrated in both sides of the disposable front end may also be designed such that the sausage foil at the cylindrical walls of the front end is not prevented from folding in a concertina-like manner to a minimum length. Thus, a maximum expulsion of the material from the sausages can be achieved.

The present invention also provides a dispensing gun for two component sausage packs which comprises two barrels for holding sausages, a lip-seal piston in each barrel for dispensing the contents of the sausages and a disposable manifold unit (front end) as described above.

The inner diameter of the barrels and the inner diameter of the cylinders in the front end should be about the same so as to allow the lip seal pistons to pass easily from the barrels to the front end, and then back again.

The lip-seal pistons preferably have one or more airholes in them. The airholes preferably have a diameter of 0.5 to 1 mm in order to avoid any of the sausage casing from entering. The airholes improve the mixing ratio accuracy by avoiding air inclusions inside the dosing area of the sausage pack system. They also help to prevent any suction effects when the pistons are retracted when the sausage are empty and thereby help in retaining the empty sausages in the front end for disposal.

The front end may be fitted to the barrels by various means for example by ball loaded catches or draw latches. Draw latches can be adjustable and may be connected to the outside of the barrels and fix the front end to the dispensing gun by a stiff plate into which they fit.

It should be ensured that there is no gap between the front end and the barrels of the gun so that there is no possibility of the sausage foil being pressed out and bursting.

Using specially designed auxiliary parts, existing two-component cartridge guns can easily be modified for the use of sausage packs in combination with disposable front ends according to the present invention with all the advantages of waste reduction associated with this.

Auxiliary parts needed are a double side-by-side barrel; two pistons preferably with flexible lip seals; and positioning block with integrated piston protection.

In order to add these parts to the existing guns, the original gun piston plates have to be removed. The correct positioning of the positioning block to the gun is achieved by two bores fitting on the piston rods. It can be fixed e.g. by bonding. The correct positioning of the back of the double side-by-side barrel may be ensured through small grooves into which ball loaded catches on the barrel fit, or the other way round i.e. there are small grooves in the barrel and ball loaded catches in the positioning block. This together with a taper angle at the end of the barrel allows a smooth entrance of the pistons with their flexible lip seals. Through the geometry of the positioning block, the lip seal pistons, which are sensitive against damage, are protected during the re-loading of the double barrel with new sausages. The lip seal pistons are designed such that they will fit onto the piston rods with screws or the like. One function of the double side-by-side barrel is to support the flexible sausages inside the gun, and, by its dimension (and the sausages' dimensions), to provide the correct mix ratio. Another function is to house the front end as described before for the new dispensing guns for sausages. To avoid a gap between the front end and the double barrel when dispensing the sausages, ball loaded catches or draw latches may be used to apply the necessary pressure to keep both parts together.

The invention therefore also provides a conversion kit for converting existing two component cartridge guns into a dispensing gun for two component sausage packs which comprises a double side-by-side barrel, two pistons with flexible lip seals and a positioning block having two bores which fit on the piston rods of the gun.

The invention also provides a dispensing gun for two component sausage packs comprising a conversion kit as described above.

BRIEF DESCRIPTION OF DRAWINGS

The invention is illustrated, by way of example, with reference to the accompanying drawings, in which.

DETAILED DESCRIPTION OF INVENTION

Figure 1:
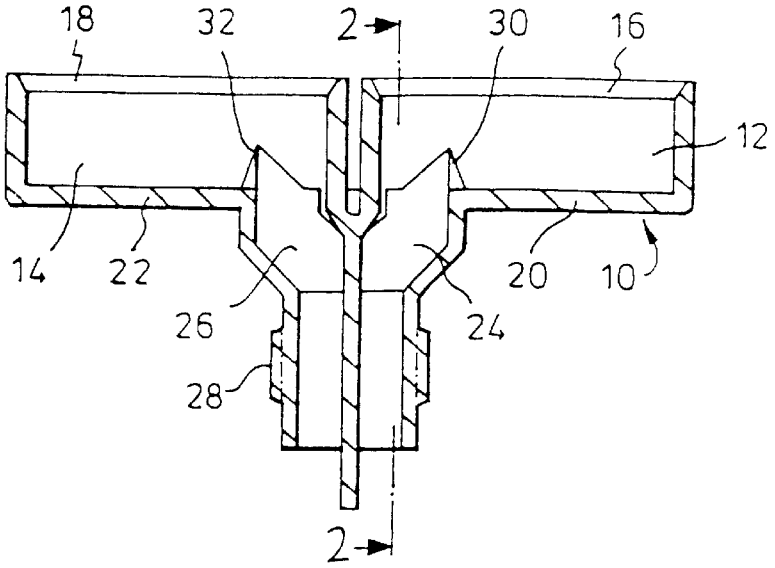
FIG. 1 is a cross section through a front end according to the invention.
Figure 2:
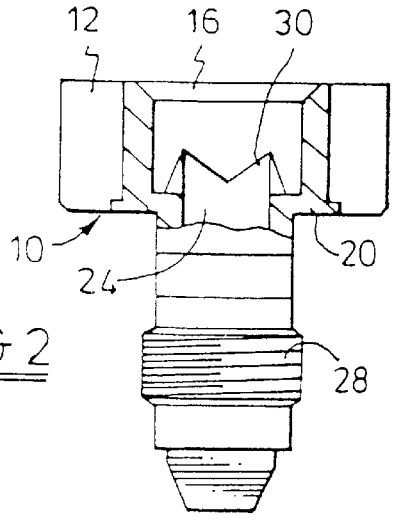
FIG. 2 is a section taken along line 2—2 in FIG. 1.
Figure 3:
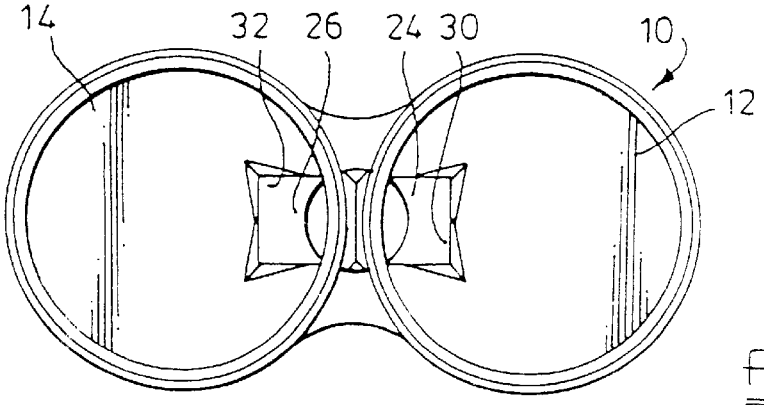
FIG. 3 is a plan view of the front end of FIG. 1.

Referring to the drawings, FIGS. 1, 2 and 3 show a disposable front end 10 having two cylinders 12, 14 having open ends 16, 18 and closed ends 20, 22. Closed ends 20, 22 each has a passageway therethrough 24, 26. Front end 10 may have a mixing nozzle fitted by means of screw thread 28 and a conical mixer adaption. Front end 10 in FIG. 1, 2 and 3 is shown with optional integrated punching nozzles 30, 32 for piercing a sausage.

Figures 4, 4A:
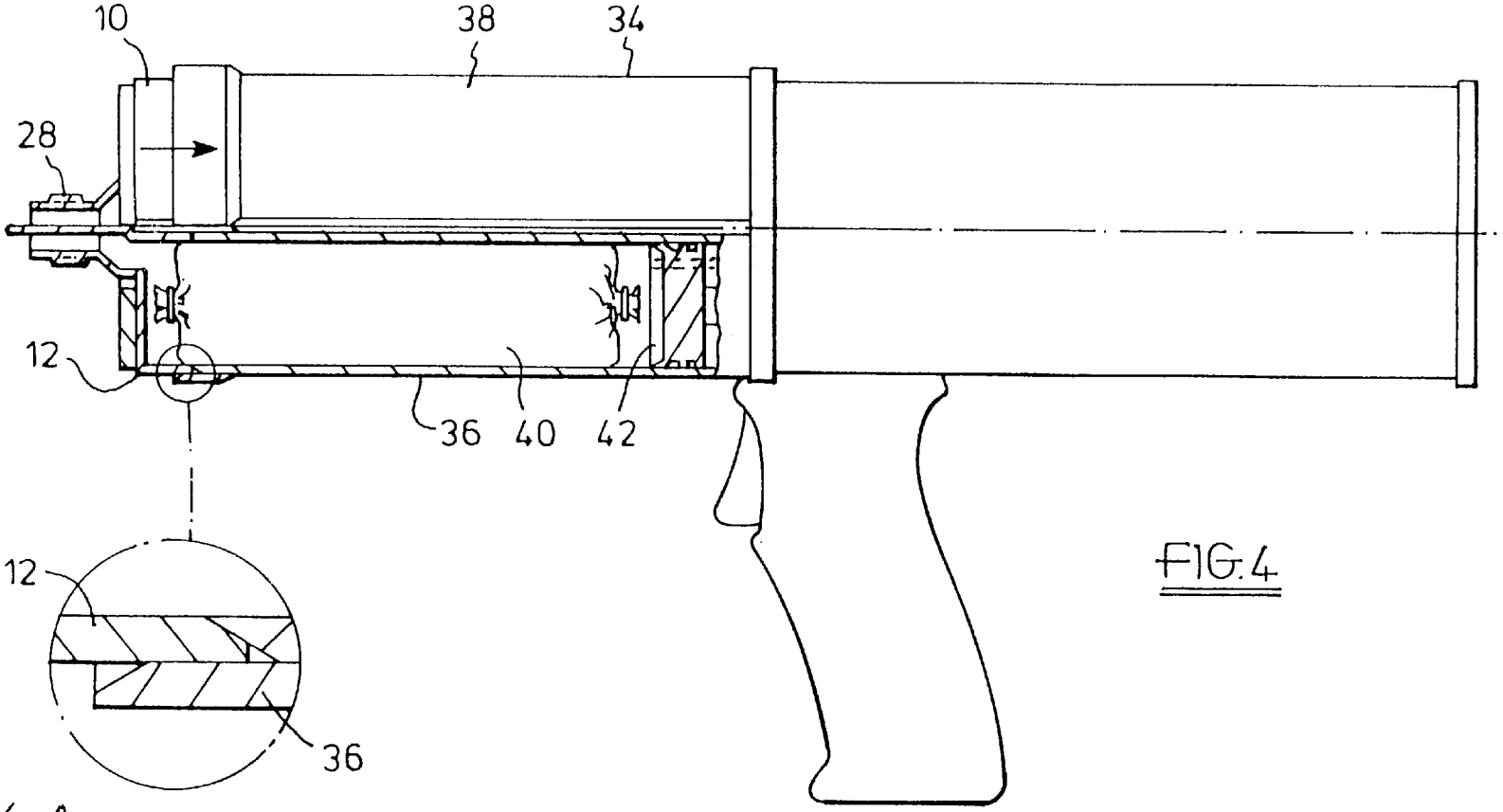
FIG. 4 is a side view, partly cut away showing a dispensing gun according to the invention.
FIG. 4A is partial cutaway of the dispensing gun of FIG. 4.

For use, front end 10 is affixed to dispensing gun 34 as shown in FIG. 4. The smooth fitting together of cylinder 12,14 with barrels 36, 38 of gun 34 is shown in the enlarged portion illustrated in FIG. 4. Barrels 36, 38 are fitted with sausages (one shown at 40) and each has a lip seal piston 42, which preferably has an airhole therethrough.

Figure 5:
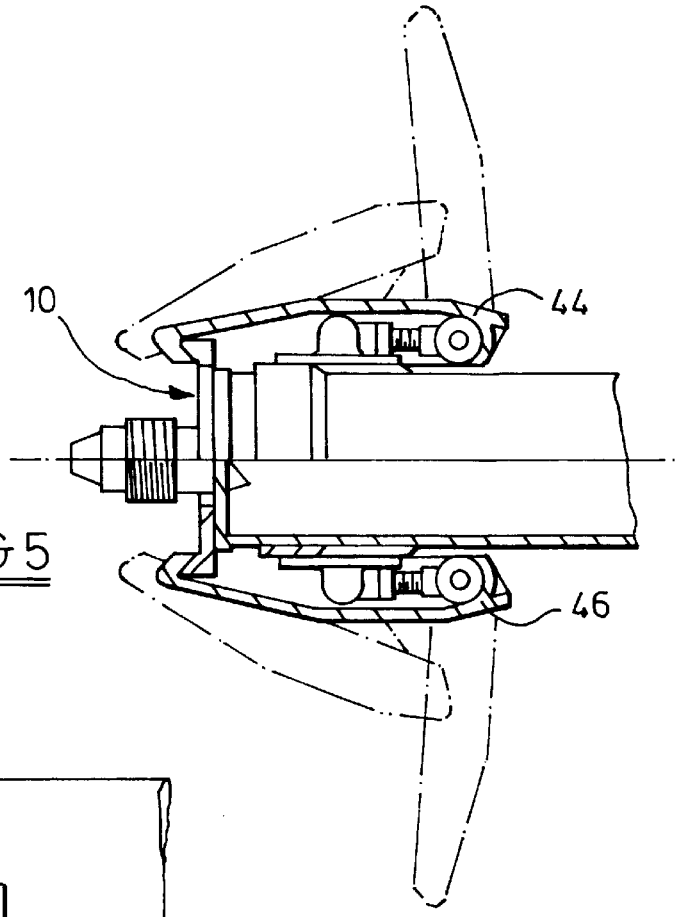
FIG. 5 shows one method of fitting a front end to a gun.
Figure 6:
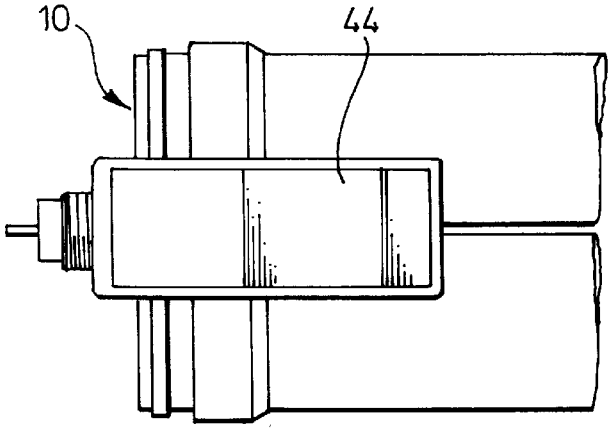
FIG. 6 is a plan view of the gun in FIG. 5.

A means of fitting is shown in FIGS. 5 and 6 where front end 10 is held in place by draw latches 44, 46.

Figure 7:
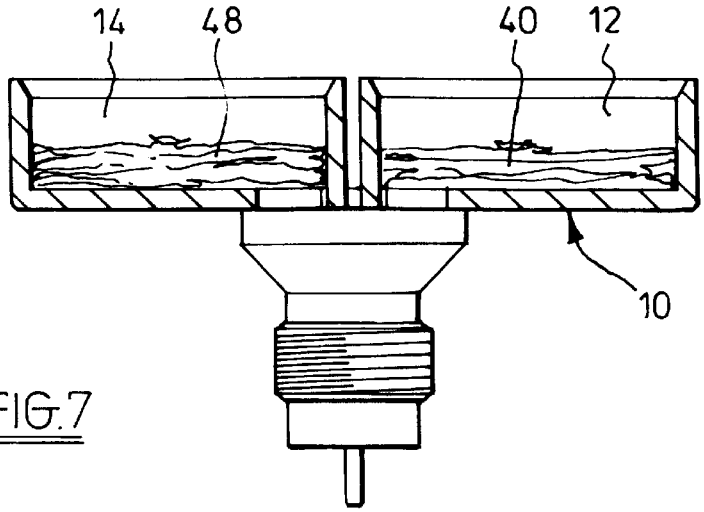
FIG. 7 shows the waste product.

FIG. 7 shows the waste which is disposed after use of the two sausages. This shows the sausages emptied to their minimum 40, 48 contained within cylinders 12, 14 of front end 10.

Figure 8:
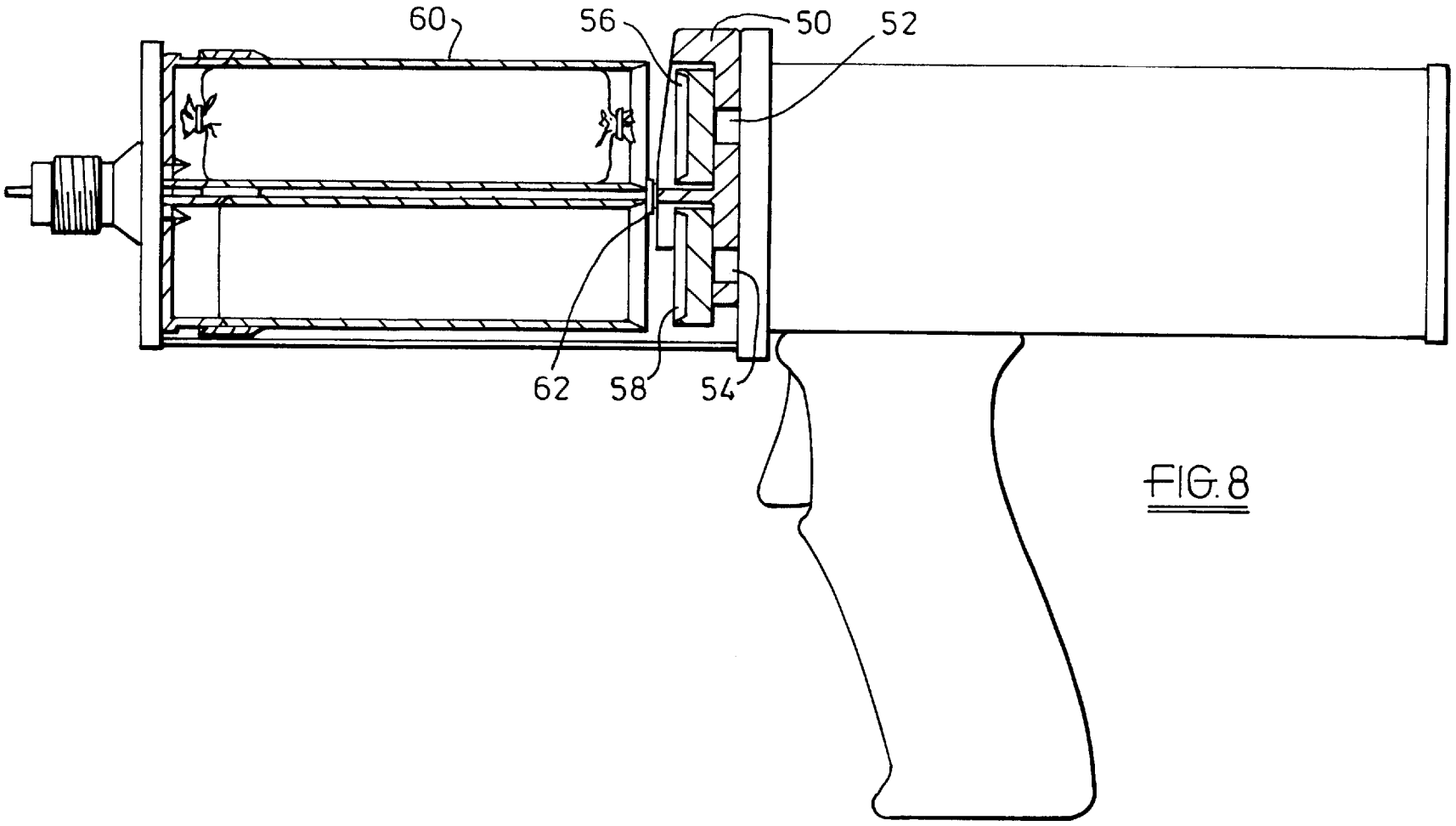
FIG. 8 shows a modified gun.

FIG. 8 shows a modified gun which has positioning block 50 having two bores 52, 54 for fitting on the piston rods (not shown). Two pistons with lip seals 56, 58 are fitted as is double side-by-side barrel 60 which is fitted to positioning block 50 in the centre at 62. Barrel 60 carried disposable front end 10.

In use the gun is loaded with a sausage in each barrel as shown in FIGS. 4 and 8 and then the front end is fitted. The gun may then be operated manually or pneumatically, depending on the design of the gun, and the pressure applied forces the sausages against the punching nozzles which are thereby pierced. More pressure then forces the contents of the sausages through the passages. The contents are mixed in a mixing nozzle fitted to the end and applied where required.

When the sausages are emptied to their minimum, they will have been compressed and are contained in the front end as shown in FIG. 7. This is then removed from the gun and disposed of complete with the emptied compressed sausages. The gun is now ready for two more sausages and a new front end.

When sausages are used which have a diameter about the same as the inner diameter of the barrels and front end, the concertina-like folds of the foil of the sausage ensure that the barrels of the gun are clean and not contaminated with the contents of the sausages. This also applies when a sausage is used which has a slightly larger diameter than the inner diameter of the barrels and front end, but which is only filled to such as extent that it is not stiff, but remains flexible and can be inserted into the barrels.

I claim:

1. A disposable manifold unit (10) capable of fitting to a dispensing gun (34) for two component sausage packs which comprises two parallel barrels (36), (38) for holding sausages (40), a lip seal piston (42) in each barrel for dispensing the contents of the sausage, which manifold (10) comprises a housing having two parallel cylinders (12), (14) each having a closed end (20), (22) and an open end (16), (18), each closed end having a passage therethrough (24), (26), fixing means on the outer side of the closed ends for affixing a mixing nozzle (28) thereto with each passage for dispensing a mixture of the two components, each open end fixing by interference fit, two parallel cylinders capable of holding filled un-used sausage, and wherein each cylinder (12), (14), of the manifold unit is of such length and diameter as will enable it to receive and retain a discharged sausage from a dispensing gun.

2. A unit as claimed in claim 1 which comprises a punching nozzle around each passage for punching the sausages.

3. A unit as claimed in claim 2 in which the punching nozzles are positioned eccentrically.

4. A dispensing gun for two component sausage packs which comprises two barrels having a front end and a back end for holding sausages, a lip seal piston in each barrel for dispensing the contents of the sausages and a manifold unit as claimed in any preceding claim affixed to the front end of the barrels.

5. A gun as claimed in claim 4 in which said unit is affixed by means of draw latches.

6. A gun as claimed in claim 4 in which the inner diameter of the barrels and the inner diameter of the cylinders in said unit are about the same, and enable the lip seal pistons to pass from the barrels and into the cylinders.

7. A gun as claimed in claim 4 in which each lip seal piston has one or more airholes.

8. A gun as claimed in claim 4 which contains a sausage in each barrel, and wherein the diameter of each sausage is about the same as or is slightly larger than the inner diameter of each barrel.

* * * * *